United States Patent [19]

Oda

[11] 4,221,027

[45] Sep. 9, 1980

[54] LOCKABLE SLIDER FOR SLIDE FASTENERS

[75] Inventor: Kiyoshi Oda, Kurobe, Japan

[73] Assignee: Yoshida Kogyo K. K., Japan

[21] Appl. No.: 45,606

[22] Filed: Jun. 5, 1979

[30] Foreign Application Priority Data

Jun. 16, 1978 [JP] Japan ..... 53-81482[U]

[51] Int. Cl.[2] ..... E05B 67/38

[52] U.S. Cl. ..... 24/205.14 R; 70/68

[58] Field of Search ..... 70/68; 24/205.15 R, 24/205.14 R, 205.14 A, 205.14 K

[56] References Cited

U.S. PATENT DOCUMENTS

| | | | |
|---|---|---|---|
| 2,166,581 | 7/1939 | Carlile | 70/68 |
| 3,270,535 | 9/1966 | Fukuroi | 70/68 |
| 3,335,586 | 8/1967 | Levine et al. | 70/68 |
| 4,015,457 | 4/1977 | Fukuroi | 70/68 |
| 4,019,353 | 4/1977 | Christopher | 70/68 |
| 4,031,724 | 6/1977 | Atkinson | 70/68 |
| 4,112,990 | 9/1978 | Anderson | 70/68 |

FOREIGN PATENT DOCUMENTS

| | | | |
|---|---|---|---|
| 1927483 | 1/1970 | Fed. Rep. of Germany | 24/205.1 R |
| 1036410 | 7/1966 | United Kingdom | 70/68 |

*Primary Examiner*—Roy D. Frazier
*Assistant Examiner*—Peter A. Aschenbrenner
*Attorney, Agent, or Firm*—Hill, Van Santen, Steadman, Chiara & Simpson

[57] ABSTRACT

Disclosed is a lockable slider for a slide fastener in which but a single spring is provided on the fore thereof that has double functions to urge a cylindrical member upwardly for enabling the rotation thereof by a separate key and to simultaneously bias the fore end of a locking lever pivotally supported at its middle upwardly to pivot it in such a way to intrude a locking pawl formed at the rear end thereof into engagement with fastener elements, thus locking the slider relative thereto. The lockable slider thus permits to be the more compact in its rear, rendered itself the more attractive in appearance compared with the prior art slider equipped with two springs, one on the fore and the other on the rear thereof.

11 Claims, 11 Drawing Figures

LOCKABLE SLIDER FOR SLIDE FASTENERS

BACKGROUND OF THE INVENTION

1. Field of the Invention

This invention relates to a slide fastener and more particularly to a lockable slider for slide fasteners.

2. Description of the Prior Art

The invention is an improvement on the slider described, illustrated and claimed in the applicant's preceding United States Pat. application (Filed Oct. 28, 1964, Ser. No. 407,199) which has already matured as United States Pat. No. 3,270,535. The slider is of the type comprising a slider body, a cylindrical member rotatably enclosed at the fore thereof and having a slanted annular cam face at its lower surface, a compression coil spring urging the cylindrical member upwardly for enabling the rotation thereof by a separate key, a locking lever pivotally at its middle mounted on the slider body, having its one end held in contact with the slanted annular cam face of the cylindrical member and provided at the other end with a locking pawl, and a separate resilient member, a leaf spring provided at the rear of the slider body urging the locking lever downwardly, so that the locking pawl is brought into locking engagement with interlocking fastener elements in response to the rotation of the cylindrical member.

This type of slider has certainly gained appreciable and valuable advantages that since the locking pawl is not actuated directly by cam motion but is actuated indirectly through a spring force in an extremely natural manner, even if the pawl would come into contact with the tops of fastener elements at the beginning of locking motion, but not proceed into the interspace of fastener elements, the cylindrical member is not prevented from turning continuously by virtue of the resiliency of spring, and when the slider body is moved slightly, the pawl automatically gets into the next interspace of fastener elements to effect the required locking, so that locking mechanism is never subjected to any such compulsive force during locking operation that might damage the parts. In addition, because of the fact the locking pawl is under the resilient restraining force by virtue of spring in the locking position, the slider body can be moved further in the direction of closing the slide fastener, but not in the opposite direction. Consequently, in a travelling bag for example, the key may be inserted into the key holes at any convenient position easy for operation of the key for effecting the locking, and then the key may be withdrawn from the key holes, while the slider body can be moved further in closing direction.

Notwithstanding the advent of these appreciable advantages, the prior art slider is found to have still suffered from various drawbacks which arise from the same cause, the inevitable provision of the additional leaf spring above the locking lever and hence at the rear of the slider body. Firstly, this requires the rear of the slider to become relatively bulky, thereby rendering the slider as a whole unsightly or ugly in appearance. Secondly, the addition of the part makes the assemblage of the lockable slider the more complex, time-consuming and tedious in a natural consequence. This is more so when the part to be added is resilient as is the case in this prior art lockable slider. Thirdly, this entirely precludes the possibility of providing an aperture large enough to loosely receive the pintle or pivotal end of the pull tab thereon for free movement thereof relative to the slider body. Such free movement of the pull tab relative to the slider body is very significant from the standpoint that this type of lockable slider finds its most application to a travelling bag, a brief case and so forth, which articles are likely to be positioned in variable relative positions to the carrier thereof or the man manipulating the lockable slider attached thereto and thus require easy manipulation of the pull tab at any relative position of the manipulator to the pull tab.

SUMMARY OF THE INVENTION

With these various drawbacks in view, a primary object of the present invention is to provide a lockable slider which is rendered compact particularly at its rear, and hence attractive in appearance.

Another object of the present invention is to provide a lockable slider which is simple in structure and easy to assemble.

A further object of the present invention is to provide a lockable slider in which a pull tab is loosely connected to the cover for free movement of the former relative to the latter so that the pull tab can be easily manipulated by the manipulator who stands in any relative position to the lockable slider.

A still further object of the present invention is to provide a lockable slider, of which the locking mechanism can be actuated to the locking position very smoothly irrespective to the position of the slider relative to the fastener element of the slide fastener.

A yet further object of the present invention is to provide a lockable slider, which may be locked at any convenient position relative to the slide fastener, and can, thereafter, be driven further only in the direction in the slide fastener is closed fu-ther.

Other objects and a fuller understanding of the invention may be had by referring to the following description and claims, taken in conjunction with the accompanying drawings in which:

DESCRIPTION OF THE PREFERRED EMBODIMENTS

Figure 1:
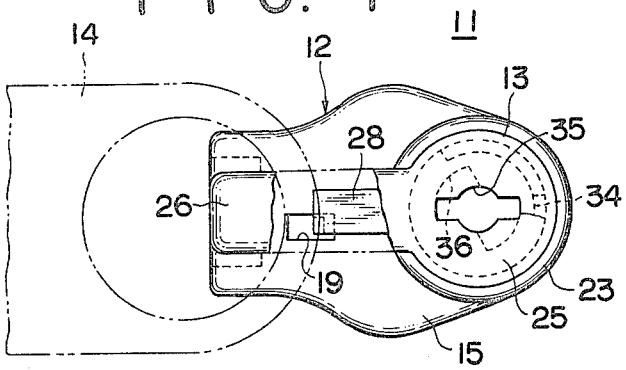
FIG. 1 is a top plan view of a lockable slider embodying the present invention with part broken away for exposure of the interior.

Referring now to the drawings, broadly designated 11 in FIG. 1 is a lockable slider which is adapted to reciprocally slide along rows of interlocking fastener elements mounted on and along the respective longitudinal edges of a pair of stringer tapes (not shown) which are conventional per se in the art and to be locked relative to the interlocking fastener elements, when required, by a locking mechanism hereinafter referred to. The lockable slider 11, as better shown in FIGS. 1 and 4, broadly comprises a slider body 12, a cover 13 mounted thereon, a pull tab 14 pivotally connected to the cover 13 and the locking mechanism operatively enclosed between the slider body 12 and the cover 13.

Figure 4:
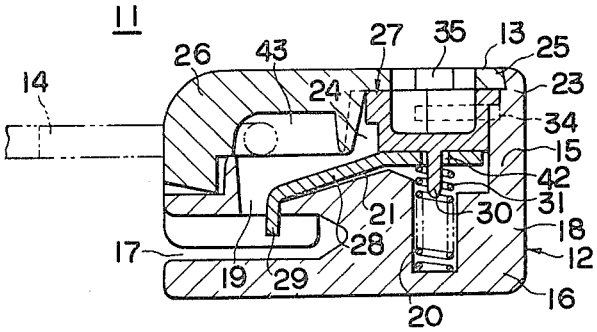
FIG. 4 is a longitudinal sectional view of the lockable slider shown in FIG. 1 with the parts in locking position.
Figure 5:
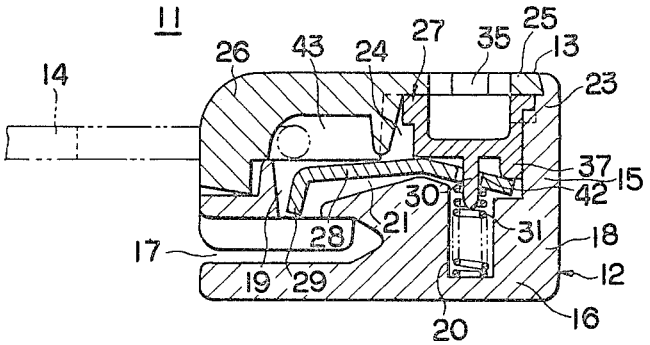
FIG. 5 is a view similar to FIG. 4, but with the parts in unlocking position.
Figure 6:
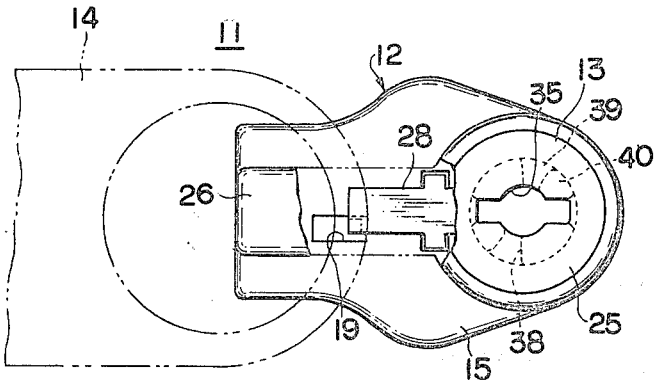
FIG. 6 is a view somewhat similar to FIG. 1, showing another embodiment of the present invention.
Figure 7:
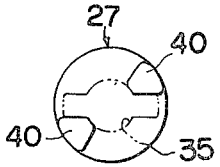
FIG. 7 is a view similar to FIG. 2, but showing the cylindrical member used in the second embodiment.
Figure 8:
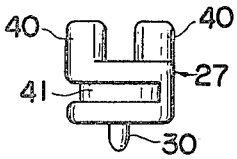
FIG. 8 is a front elevation of the cylindrical member shown in FIG. 7.
Figure 9:
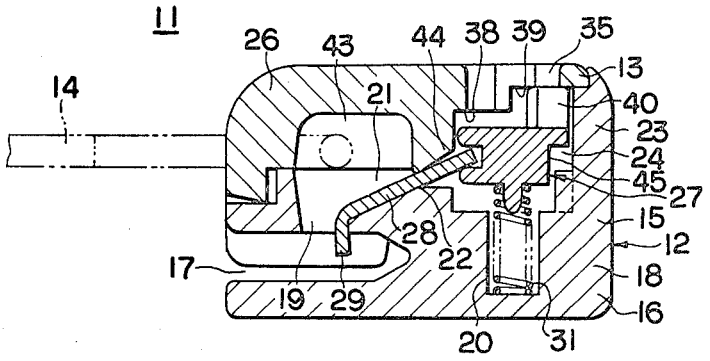
FIG. 9 is a longitudinal sectional view of the lockable slider shown in FIG. 6 with the parts in locking position.
Figure 10:
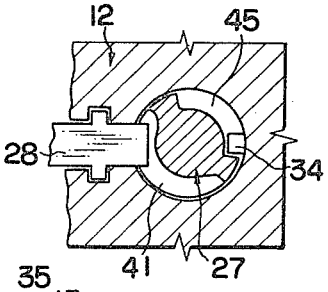
FIG. 10 is a fragmentary, horizontal sectional view of the lockable slider shown in FIG. 6.
Figure 11:
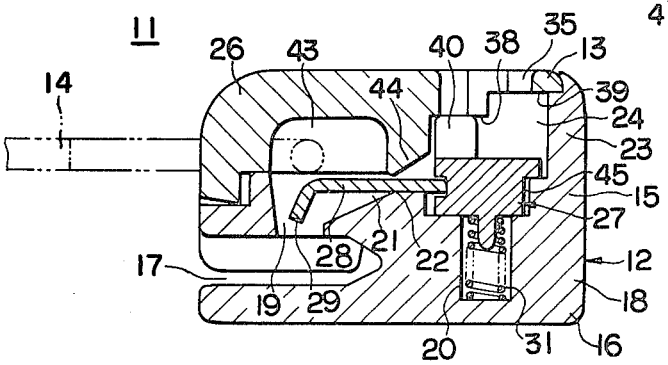
FIG. 11 is a longitudinal sectional view of the lockable slider shown in FIG. 6 with the parts in unlocking position.

The slider body 12, as better shown in FIGS. 4 and 5, comprises an upper and a lower wing 15, 16 so connected at their fore by a neck 18 as to define therewith a Y-shaped channel 17 which extends longitudinally of and throughout the slider body 12 and through which the interlocking fastener elements slidably pass for opening or closing the slide fastener. In the neck 18 of the slider body 12 is formed a cylindrical cavity 20 extending perpendicular to the plane of the slider body 11 and being open upwardly. Adjacent the rear end of the upper wing 15 is formed an aperture window 19 which communicates with the Y-shaped channel 17. Between the aperture 19 and the cylindrical cavity 20 on the upper surface of the upper wing 15 is provided a groove 21 of which the bottom surface is raised in the middle, the provision of the groove facilitating the assemblage onto the slider body 12 of a locking lever hereinafter referred to. Projecting upwardly from the upper surface of the upper wing 15 and formed around and coaxially of the cylindrical cavity 20 is a cylindrical shell 23 to define within itself a cylindrical bore 24 which is greater in diameter than the cylindrical cavity 20.

The cover 13, when viewed in plan as shown in FIG. 1, is in the shape of a banjo, that is to say, comprises a circular body 25 and an elongated rectangular tail 26 extending radially thereof. The banjo-shaped cover 13 is connected to the slider body 12 in such a manner that the circular body 25 is laid over and attached to the upper circular hem of the cylindrical shell 23 and the tail 26 extends first backwardly along the length of the slider body 12, is then turned arcuately downwardly and terminates in connection to the rear edge of the upper wing 15, thus to define a relatively large aperture 43 with the upper surface of the upper wing 15. Through and centrally of the circular body 25 is formed a key hole 35 through which the separate key is inserted to actuate the locking mechanism.

The pull tab 14 is in the shape of a substantially rectangular plate and has formed at its fore end a circular aperture with an arcuate edge left at the fore extremity. This arcuate edge is loosely inserted through the relatively large aperture 43 for the function as a pintle when the pull tab 14 is pivotally connected to the elongated tail 26.

In accordance with a first preferred embodiment of the invention illustrated in FIGS. 1 through 5 inclusive, the locking mechanism broadly comprises a cylindrical member 27 rotatably received within the cylindrical bore 24, a locking lever 28 held pivotally at its middle, having its fore end slidably engaged with the lower surface of the cylindrical member 27 and having the rear end bent downwardly to provide a locking pawl 29 adapted to pass through the aperture window 19, and a compression spring 31 nested within the cylindrical cavity 20 and urging the fore end of the locking lever 28 and the cylindrical member 27 upwardly.

Figure 2:
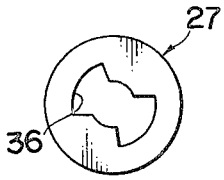
FIG. 2 is a top plan view of the cylindrical member constituting one of the essential parts of the present invention.
Figure 3:
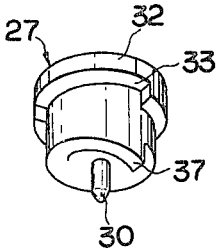
FIG. 3 is a perspective view of the cylindrical member shown in FIG. 2.

As shown in detail in FIG. 3, the cylindrical member 27 has an axial pin 30 formed on and projecting axially downwardly from the lower surface thereof. Also on the lower surface and along the partial circumference of the cylindrical member 27 is formed a slanted annular cam face 37. As shown in FIGS. 4 and 5, the cylindrical member 27 is rotatably mounted within the cylindrical bore 24 while biased upwardly via the fore end of the locking lever 28 by the compression coil spring 31, with the axial pin 30 inserted through the aperture 42 formed at the fore end of the locking lever 28 into the interior space defined by the compression coil spring 31 therethrough. Centrally on the upper surface, as shown in FIG. 2, the cylindrical member 27 is formed with a key recess 36 into which to receive the operative tip of the separate key for the rotation of the cylindrical member 27 thereby. The key recess 36 is of such configuration as to comprise a central circular and a pair of integral sectors simmetrically disposed on the opposite sides thereof with their arcs arranged remote from the central circle. On the periphral surface of the cylindrical member 27 is formed a peripheral rim 32 which is partly cut away to provide a partial peripheral recess 33 as shown in FIG. 3. Provided on and projecting inwardly from the interior surface of the cylindrical shell 23 is a stopper 34 which is adapted to come into slidable engagement with the partial peripheral recess 33 of the cylindrical member 27 for cooperating with the latter in confining the degree of rotation of the cylindrical member 27 within the cylindrical bore 24. The relative location to the stopper 34 and the length of the partial peripheral recess 33 is calculated such that at one of the limits the lockable slider 11 is locked relative to the rows of interlocking fastener elements and at the other limit is unlocked therefrom.

With the structure stated hereinbefore, the locking mechanism according to the invention operates as follows. For unlocking the slider 11 from the fastener elements, the separate key is inserted through the key hole 35 into the operative engagement with the key recess 36 of the cylindrical member 27 and then turned clockwise, thereby to rotate the cylindrical member 27 clockwise on the axial pin 30 within the cylindrical bore 24. As the cylindrical member 27 is rotated, the fore end of the locking lever 28 slides progressively downwardly along the annular slanted cam face 37 against the bias of the compression coil spring 31. As a result, the locking lever 28 as a whole pivots clockwise when viewed in FIG. 5, the pivot being constituted herein by that part of the peripheral edge, diametrically opposite to the camface-providing part, of the lower surface of the cylindrical member 27. When the fore end of the locking lever 28 reaches the lowermost point of the slanted cam face 37, the locking lever 28 assumes the position indicated in FIG. 5 in which the locking pawl 29 is lifted fully out of the channel 17 off the interlocking fastener elements, which leads to unlocking of the lockable slider 11 from the fastener elements. For locking the slider 11 to the fastener elements, the separate key is now turned anti-clockwise on the pin 30 causing the anti-clockwise rotation of the cylindrical member 27. The anti-clockwise rotation of the cylindrical member 27 causes the fore end of the locking lever 28 to slide progressively upwardly along the annular slanted cam face 37 through the bias of the compression coil spring 31. As a result, the locking lever 28 as a whole pivots anti-clockwise on the above-mentioned part of the peripheral edge. When the fore end of the locking lever 28 reaches the uppermost point of the slanted annular cam face 37, the locking lever 28 assumes the position indicated in FIG. 4 in which the locking pawl 29 is intruded through the aperture window 19 into the Y-shaped channel 17 into engagement with the interlocking fastener elements, which leads to locking of the lockable slider 11 relative to the fastener elements.

Turning now to a second embodiment of the present invention illustrated in FIGS. 6 through 11 inclusive, the lockable slider 11 of this embodiment is substantially idential to that of the preceding embodiment with the exception of the construction and operation of the means for imparting vertical movement to the fore end of the locking lever 28 either through or against the bias of the compression coil spring 31, the manner of holding the fore end of the locking lever 28 in independent holding engagement with the cylindrical member 27 and the point constituting a pivot on which a locking lever 28 is pivotally supported.

In accordance with the second embodiment, the circular body 25 has formed on, projecting downwardly from its lower surface and extending axially on and along the inner peripheral surface of the cylindrical shell 23 a pair of lugs 38, 38 which are disposed diametrically opposite to each other, thus to leave, at the remaining part of said lower surface, a pair of complementary retracted recesses 39, 39 which are also disposed diametrically opposite to each other, so that the lugs 38, 38 and the complementary recesses 39, 39 are alternately arranged along the periphery of the lower surface of the circular body 25. These lugs 38, 38 and recesses 39, 39 shown herein are each, when viewed in horizontal section, in the shape of a sector of which the two radii are separated a right angle so as to make a complete circule together. Provided on and protruding upwardly from the upper surface of the cylindrical member 27 are a pair of abutments 40, 40 which are positioned diametrically opposite to each other as is better shown in FIGS. 7 and 8.

The cylindrical member 27 has formed on the peripheral surface a partial peripheral groove 41 into which the fore end of the locking lever 28 is slidable embedded for accomplishing an independent holding engagement with the cylindrical member 27. Also formed on the peripheral surface of the cylindrical member 27 is a partial peripheral recess 45 which is adapted to be engaged with the stopper 34 for the confining the degree of rotation of the cylindrical member 27 as with the first embodiment.

The middle raised point 22 of the groove 21 functions, in this embodiment, as a fulcrum on which the locking lever 28 is pivotally mounted. The tail 26 has formed at its lower surface and adjacent to the body a hanging stud 44 which projects downwardly to such a point as to almost touch the locking lever 28 so as to help the fulcrum 22 in supporting the locking lever 28 for pivotal movement.

Such being the structure, the locking mechanism operates as follows. For unlocking the slider 11 from the fastener elements, the key is inserted through the key hole 35 into contact with the upper surface of the cylindrical member 27. Further insertion of the key through the key hole 35 causes the cylindrical member 27 descend against the bias of the compression coil spring 31 until the cylindrical member 27 is brought into contact with the bottom of the cylindrical bore 24, when the tops of the abutments 40, 40 stand slightly below and beyond the bottom of the lugs 38, 38. At this moment, the key is turned, thereby to rotate the cylindrical member 27 with the operative tip of the separate key cooperatively engaged with the abutments 40, 40 until the cylindrical member 27 assumes the depressed position indicated in FIG. 11 in which both the abutments 40, 40 are brought into contact with the respective lugs 38, 38. The descent of the cylindrical member 27 and hence of the fore end of the locking lever 28 engaged therewith causes the locking lever 28 as a whole to pivot clockwise on the fulcrum 22 when viewed in FIG. 11, thereby fully lifting the locking pawl 29 through the aperture window 19 from the Y-shaped channel 17 and disengaging it from the fastener elements lying within the channel 17. For locking the slider 11 to the interlocking fastener elements, the key is now turned reversely until the abutments 40, 40 disengage from the lugs 38, 38. Upon such disengagement, the cylindrical member 27 is immediately lifted by the force of the compression coil spring 31 until being restored to the elevated position indicated in FIG. 9, in which both the abutments 40, 40 rest in the recesses 39, 39. The ascent of the cylindrical member 27 causes the locking lever 28 to pivot anti-clockwise on the fulcrum 22 when viewed in FIG. 9, thereby intruding the locking pawl 29 through the aperture window 19 into the Y-shaped channel 17 leading to the locking engagement of the locking pawl 29 with the interlocking fastener elements lying within the Y-shaped channel 17.

It is appreciated from the foregoing that, since the locking lever 28 at its fore end is held in holding engagement with the cylindrical member 27 independently or not relying on a separate leaf spring as is so with the prior art lockable slider under consideration, for one thing, and the compression coil spring 31 used herein can accomplish double functions to urge the cylindrical member 27 upwardly for enabling the rotation thereof by the separate key and to symultaneously bias the fore end of the locking lever 28 upwardly to pivot it for locking the slider 11 relative to the fastener element rows for another, the leaf spring is utterly dispensed with which would be indispensably provided on the rear end of the locking lever and hence at the rear of the slider in case of the prior art slider under consideration. The omission of the leaf spring permits the concentration of all the other parts of locking mechanism at the fore of the slider, which descreases the tail 26 of the cover 13 in size, thereby improving the appearance of the slider 11 as a whole. The omission of the leaf spring, in addition, naturally renders the structure of the lockable slider 11 simple and the assemblage thereof easy. Furthermore, since no part need be provided in the tail 26 of the cover 13, it is possible to provide it with an aperture 43 therethrough and laterally thereof large enough to loosely receive the pintle or pivotal end of the pull tab 14 therethrough. The loose connection of the pivotal end with the tail 26 of the cover 13 permits the free movement of the pull tab 14 relative to the slider body 12, which allows the manipulator to easily manipulate the slider 11 through the aid of the pull tab 14 at whatever relative place he may stand to the slider 11. Still furthermore, in spite of the omission of the leaf spring, the reliable operation of the locking mechanism is assuredly retained and all the effects stated hereinbefore with respect to the prior art lockable slider equipped with two springs can be still obtained.

Although the invention has been described in its preferred forms with a certain degree of particularity, it is understood that the present disclosure of the preferred forms have been made only by way of example and that numerous changes in the details of construction and the combination and arrangements of parts may be resorted to without departing from the spirits and the scope of the invention hereinafter claimed.

What is claimed is:

1. A lockable slider for a slide fastener including a pair of carrier tapes having mounted rows of interlocking fastener elements on and along their respective longitudinal inner edges, said lockable slider being adapted to be locked to said rows of interlocking fastener elements by a separate key, said lockable slider, comprising:

(a) a slider body having a Y-shaped channel so formed as to pass therethrough longitudinally thereof for passage of said interlocking fastener elements therethrough and an aperture window so formed at its upper surface as to communicate with said Y-shaped channel;

(b) a cover mounted on the upper surface of said slider body and including a circular body connected to the fore of said slider body to define a cylindrical bore therewith and an elongated rectangular tail extending radially, rearwardly therefrom and longitudinally of said slider body, medially bent downwardly and eventually connected to the rear end of said slider body so as to define a relative large lateral opening with the rear of said slider body, said cylindrical bore being disposed perpendicularly to the plane of said slider, said circular body having a key hole formed centrally thereof and therethrough so as to be disposed in registry with the axis of said cylindrical bore for insertion of said separate key therethrough;

(c) a pull tab having a pintle formed at its fore end and adapted to be loosely inserted through said lateral opening to permit to be pivotally and freely connected to said rectangular tail;

(d) a cylindrical member rotatably received within said cylindrical bore, said cylindrical member being provided centrally of its upper surface with a key recess adapted to be engaged with the operative tip of said separate key for the rotation of said cylindrical member thereby, said cylindrical member being provided at its lower surface with an annular slanted cam face;

(e) a locking lever held pivotally at its middle, said locking lever having the fore end held beneath the cylindrical member for slidable movement along said annular slanted cam face and having its rear end formed with a locking pawl adapted to pass through said aperture window into said channel; and (f) a spring member provided immediately under the fore end of said locking lever and urging the fore end of said locking lever and said cylindrical member upwardly so that the fore end of said locking lever is shiftable by the turn of said separate key either through or against the bias of said spring member between elevated position in which the fore end of said locking lever reaches the uppermost point of said slanted annular cam face and depressed position in which the former reaches the lowermost point of the latter, whereby said locking lever pivots in such a manner to, at said elevated position, intrude said locking pawl into said channel into engagement with said interlocking fastener elements leading to locking of said lockable slider thereto and, at said depressed position, lift said locking pawl out of said channel off said interlocking fastener elements leading to unlocking of said lockable slider therefrom.

2. A lockable slider recited in claim 1, including means for confining the degree of rotation of said cylindrical member within said cylindrical bore, such that at one of the limits said lockable slider is locked to said rows of fastener elements and at the other limit said lockable slider is unlocked therefrom.

3. A lockable slider recited in claim 2, wherein said confining means comprises a peripheral rim formed on the circumferntial surface of said cylindrical member and partly cut away to provide a partial peripheral recess therein, and a stopper projecting inwardly from the interior peripheral surface of the portion defining said cylindrical bore for being slidably received within said partial peripheral recess.

4. A lockable slider recited in claim 1, wherein said spring member comprises a compression coil spring.

5. A lockable slider recited in claim 4, wherein said cylindrical member is provided on its lower surface with an axial pin extending axially downwardly therefrom, said locking lever having its fore end formed with an aperture, said axial pin being adapted to fit through said aperture into the cylindrical space defined by said compression coil spring therethrough.

6. A lockable slider for a slide fastener including a pair of carrier tapes having mounted rows of interlocking fastener elements on and along their respective longitudinal inner edges, said lockable slider adapted to be locked to said rows of interlocking fastener elements by a separate key, said lockable slider, comprising:

(a) a slider body having a Y-shaped channel so formed as to pass therethrough longitudinally thereof for passage of said interlocking fastener elements therethrough and an aperture so formed at its upper surface as to communicate with said Y-shaped channel;

(b) a cover mounted on the upper surface of said slider body and including a circular body connected to the fore of said slider body to define a cylindrical bore therewith and an elongated rectangular tail extending radially, rearwardly therefrom and longitudinally of said slider body, medially bent downwardly and eventually connected to the rear end of said slider body so as to define a relatively large lateral opening with the rear of said slider body, said cylindrical bore being disposed perpendicularly to the plane of said slider, said circular body having a key hole formed centrally thereof and therethrough so as to be disposed in registry with the axis of said cylindrical bore for insertion of said separate key therethgough, said circular body having formed on and projecting downwardly from its lower surface a pair of lugs which are disposed diametrically opposite to each other, thus to provide, at the remaining part of said lower surface, a pair of complementary retracted recesses which are also disposed diametrically opposite to each other;

(c) a pull tab having a pintle formed at its fore end and adapted to be loosely inserted through said lateral opening to permit to be pivotally and freely connected to said rectangular tail;

(d) a cylindrical member rotatably received within said cylindrical bore, said cylindrical member having formed on and projecting upwardly from its upper surface a pair of abutments which are disposed diametrically opposite to each other, said abutments being adapted to be engaged with the operative tip of said separate key for the rotation of said cylindrical member thereby; said cylindrical member having a peripheral groove formed along its peripheral surface;

(e) a locking lever mounted pivotally at its middle on said slider body, said locking lever mounted pivotally at its middle on said slider body, said locking lever having the fore end held in slidable engagement with said peripheral groove and being provided at its rear end with a locking pawl adapted to pass through said aperture into said Y-shaped channel;

(f) a spring member urging said cylindrical member upwardly so that said cylindrical member is shiftable by the turn and symultaneous depression of said separate key either through or against the bias of said spring member between elevated position in which said abutments engage with said upwardly retracted recesses and depressed position in which said abutments engage with said said lugs whereby said locking lever pivots in such a manner to, at said elevated position, intrude said locking pawl into said channel into engagement with said interlocking fastener elements leading to locking of said lockable slider thereto and, at said depressed position, lift said locking pawl out of said channel off said interlocking fastener elements leading to unlocking of said lockable slider therefrom.

7. A lockable slider recited in claim 1, including means for confining the rotation of said cylindrical member within said cylindrical bore, such that at one of the limits said lockable slider is locked to said rows of fastener elements and at the other limit said lockable slider is unlocked therefrom.

8. A lockable slider recited in claim 7, wherein said confining means comprises a partial peripheral recess formed partially on the circumferential surface of said cylindrical member and a stopper projecting inwardly from the interior peripheral surface of the portion defining said cylindrical bore, said stopper being slidably received within said partial peripheral recess.

9. A lockable slider recited in claim 7, wherein said spring member comprises a compression coil spring.

10. A lockable slider recited in claim 9, wherein said cylindrical member is provided on its lower surface with an axial pin extending axially downwardly therefrom, said axial pin being adapted to fit through said aperture into the cylindrical space defined by said compression coil spring therethrough.

11. A lockable slider recited in claim 7, wherein said slider body is provided on its upper surface between said cylindrical bore and said aperture window with a groove of which the bottom surface is raised at its middle to provide a fulcrum upon which said locking lever pivotally supported.

* * * * *